US007900588B2

(12) United States Patent
Zimmermann et al.

(10) Patent No.: US 7,900,588 B2
(45) Date of Patent: Mar. 8, 2011

(54) FLUE SENSOR FOR GAS FIRED APPLIANCE

(75) Inventors: Bernd D. Zimmermann, Ashland, OH (US); David Reynolds, Galion, OH (US); Prasad S. Khadkikar, West Chester, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 1281 days.

(21) Appl. No.: 11/351,498

(22) Filed: Feb. 10, 2006

(65) Prior Publication Data

US 2007/0207420 A1 Sep. 6, 2007

(51) Int. Cl.
*F24H 9/20* (2006.01)

(52) U.S. Cl. ..... 122/14.21; 122/14.2; 431/22

(58) Field of Classification Search ..... 432/32; 126/299 D, 299 R
See application file for complete search history.

(56) References Cited

U.S. PATENT DOCUMENTS 3,096,020 A * 7/1963 Kraft ..... 236/14
4,406,396 A * 9/1983 Habegger ..... 236/1 G
5,280,802 A * 1/1994 Comuzie, Jr. ..... 137/65
5,531,214 A * 7/1996 Cheek ..... 122/14.1
5,697,330 A * 12/1997 Yetman et al. ..... 122/14.21
5,797,358 A 8/1998 Brandt et al.
6,318,150 B1 * 11/2001 Temple ..... 73/23.31
RE37,745 E * 6/2002 Brandt et al. ..... 122/14.2
6,571,817 B1 * 6/2003 Bohan, Jr. ..... 137/88
6,584,940 B1 7/2003 Khadkikar et al.
6,766,771 B1 * 7/2004 Hotton ..... 122/14.2
7,250,870 B1 * 7/2007 Viner et al. ..... 340/588
7,290,502 B2 * 11/2007 Kidd et al. ..... 122/14.2
7,603,967 B2 * 10/2009 Garrabrant ..... 122/13.01
7,647,895 B2 * 1/2010 Donelly et al. ..... 122/14.21
2007/0215066 A1 * 9/2007 Garrabrant ..... 122/14.1

* cited by examiner

*Primary Examiner* — Gregory A Wilson
(74) *Attorney, Agent, or Firm* — Harness, Dickey & Pierce, P.L.C.

(57) ABSTRACT

A fuel fired appliance exhaust gas parameter sensor for continually detecting gas parameter emissions, such as CO, NOx and $O_2$, may be located above the appliance near the appliance exhaust outlet. The sensor may be located near or under a draft hood located near the exhaust outlet. The sensor remains relatively cool by draft air moving from outside the draft hood and into a chimney, the draft being hastened by the heated, rising chimney gases. A sensor bracket may be attached to the appliance and the sensor to appropriately position the sensor under the draft hood. Alternatively, the sensor may be located on a tube that continually samples combustion exhaust. The tube may be located outside of the draft hood perimeter to maintain a low sensor temperature, while multiple tube coils around the exhaust outlet may be used to further cool the sampled gas.

12 Claims, 4 Drawing Sheets

FLUE SENSOR FOR GAS FIRED APPLIANCE

FIELD

The present disclosure relates generally to a flue gas sensor for a gas-fired appliance and, more specifically, to an apparatus that measures exhaust gas parameter concentrations while maintaining a low ambient apparatus temperature during regular appliance operation.

BACKGROUND

The statements in this section merely provide background information related to the present disclosure and may not constitute prior art. Monitoring of flue gas parameters, such as carbon monoxide ("CO"), Nitrogen Oxides ("NOx"), and Oxygen ("$O_2$") in a fuel fired appliance, such as a gas fired water heater, is desirable to alert surrounding inhabitants of specific levels of such exhaust gas parameters. Traditionally, such gas parameter monitoring was accomplished with a device located some distance away from the actual flow of hot, combusted flue gases. Such known devices, however, may not satisfactorily measure such gas parameters because they must be located away from the actual flow of the hot, post-combustion flue gases. This is because locating such a detection device in the actual flow of the combustion gases may subject the device to temperatures above 200 degrees Celsius, which may potentially damage the sensing instrument or its exterior casing. Locating a sensor away from the actual flow of combusted gases may delay detection, and locating a device in such a flow within a flue, may cause a sensor to become damaged and inoperable.

Additionally, when an exhaust gas parameter measuring device, such as a CO sensor, is located outside of the exhaust flow, in a reduced temperature zone, the device may only detect emission parameters when the combustion exhaust is blocked downstream of the detecting device, that is, blocked above the detecting device in a chimney. In such an instance, the exhaust flue gases are normally caused to "back up" and overflow outside of a draft hood until the combustion gases reach the detecting device located outside of the proximity of the exhaust flow. This may delay detection.

In the alternative, if the air intake, that is, the air upstream of a CO detecting device is restricted or blocked, but the exhaust flue downstream of a CO detecting device is not blocked, a CO gas detecting device located outside of the combustion exhaust flow is not capable of detecting exhaust gas CO levels that may result from improper combustion. This is because the exhaust flue is free from blockage and the flue gas parameter detecting device is located outside of the exhaust flow. The exhaust gas will not "back up" and alternatively flow toward such a device when only the airflow upstream of the sensor is compromised.

What is needed then is a device that does not suffer from the above limitations. This will result in an exhaust gas parameter detection device that detects gas parameters under all operating conditions, even when an exhaust flue is restricted downstream or upstream of the device.

SUMMARY

In accordance with the teachings of the present disclosure, an exhaust gas parameter sensor for a flue of a fuel fired appliance is disclosed. More specifically, an apparatus for detecting specific combustion gas parameter emissions, such as CO, NOx, and $O_2$, from a gas fired appliance exhaust is disclosed. The combustion gas parameter sensor may be positioned under a draft hood, just below a chimney for the combustion exhaust gas of the fuel fired appliance, making the sensor susceptible to specific gas parameters in the exhaust gas.

Just above the top surface of the appliance of which a combustion gas parameter sensor is associated, an exhaust outlet is located, above which, a draft hood is located. The draft hood permits fresh air to be drawn into the exhaust stream within the draft hood and subsequently, the exhaust chimney. The combustion gas parameter sensor may be located under the draft hood where the sensor is subject to cooling by fresh air drawn into the draft hood, before the fresh air, mixed with combustion gas, passes into the chimney.

A bracket may be utilized to position the combustion gas parameter sensor under the draft hood. By using a bracket, the sensor may be positioned within the geometric confines of the draft hood, to make the sensor more susceptible to exhaust gas parameters. Furthermore, the bracket may position the sensor such that air is permitted to flow over all sides of the sensor, between the draft hood and the sensor, and between the sensor and the appliance top surface, so that cooling of the sensor is possible in its location proximate the exhaust stream.

Alternatively, the combustion gas parameter sensor may be located on an exhaust sampling tube, through a wall of which exhaust gas parameters may be sensed by the sensor. One end of the sampling tube may be positioned in the exhaust port, where exhaust gases are drawn in, while the other end may be positioned in the exhaust chimney, where sample exhaust gases are expelled. Sampled exhaust gases are cooled as they pass through the tube, which may coil around the top surface of the appliance.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
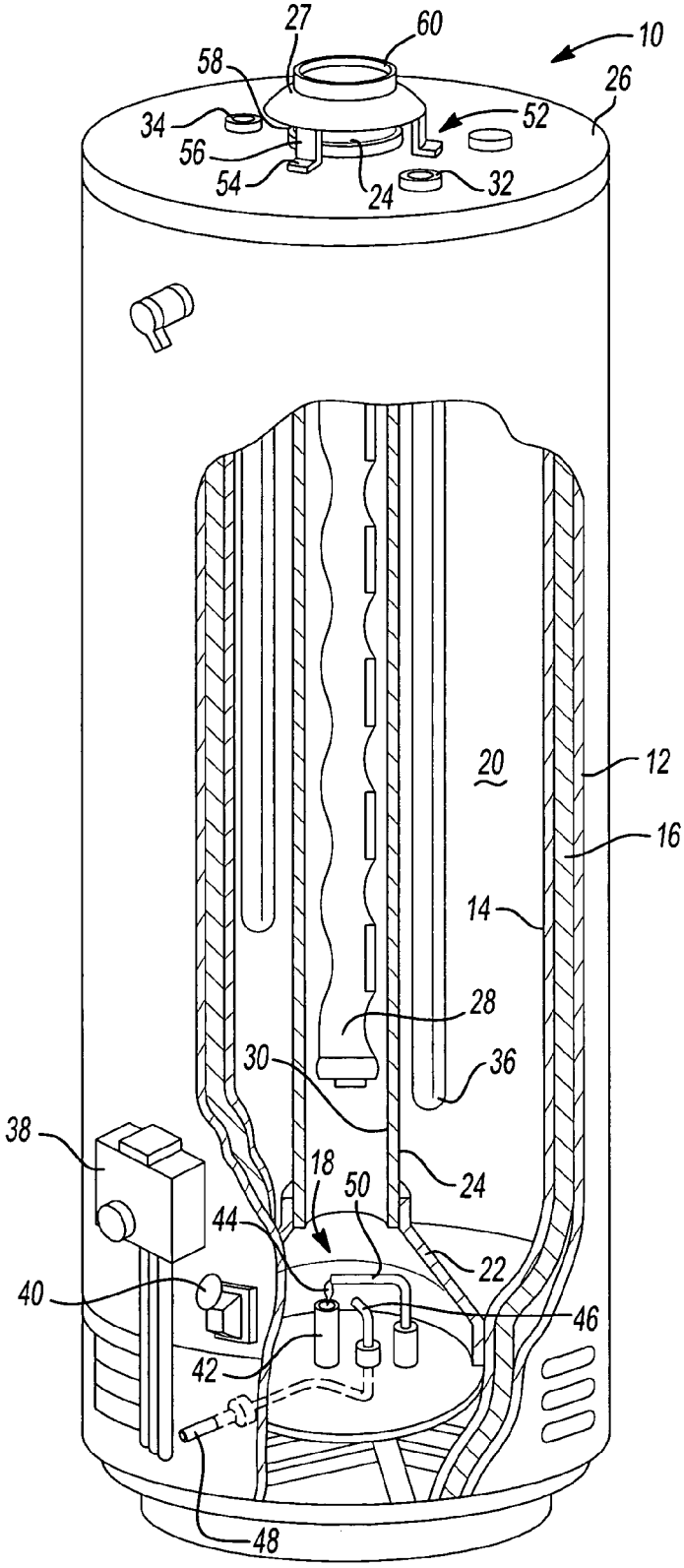
FIG. 1 is a partial cross-sectional side view of a water heater.

The following description is merely exemplary in nature and is not intended to limit the present disclosure, application, or uses. It should be understood that throughout the drawings, corresponding reference numerals indicate like or corresponding parts and features.

Referring now to FIGS. 1-4 and more specifically to FIG. 1, the operative workings of the present disclosure will be depicted and explained. FIG. 1 depicts a conventional fuel fired water heater 10, such as a gas fired water heater. Water heater 10 includes an outer housing 12 within which resides a water storage tank 14, around which is a layer of insulation 16. A gas fired burner assembly 18 resides at the bottom area of the water heater 10 that, when ignited, heats the water within water area 20. The water storage tank 14 has a generally elongated cylindrical shape, the majority of which is positioned above burner assembly 18. A generally conically shaped hood portion 22 is sealingly secured to a lower portion of tank 14 and lies around and generally above the burner assembly 18. A lower end of an axially elongated flue pipe 24 is sealingly secured to hood portion 22. The flue pipe 24 projects outwardly through outer housing 12 at the outer housing upper end 26. Such projecting end of the flue pipe 24 serves as an exhaust outlet 24. The flue pipe 24 directs smoke and combustion gases into a chimney 60 via a draft hood 27.

In operation, combustion gases generated by the firing of burner assembly 18 are directed upwardly through flue pipe 24 via hood 22 and serve to transfer heat to the water contained in water area 20 within storage tank 14. In many cases, a spirally shaped or zig zag baffle member 28 is supported within flue pipe 24 and serves to create a mixing of the combustion gases as they flow upwardly through flue pipe 24. The baffle member 28, by contributing to the mixing of combustion gases, improves heat transfer to the water by reducing any thermal boundary layer that may form along the internal surface 30 of flue pipe 24.

The water heater 10 also includes suitable fittings 32 and 34 for facilitating the flow of water into and out of the water heater 10. Specifically, fitting 32 is for connection of a cold water supply pipe to supply cold, unheated water to the tank 14. Fitting 34 is for connection of a pipe to supply heated water to a home or facility after being heated in the water heater 10. The water inlet 32 is provided with a dip tube 36 that directs the inflow of cold water to the bottom of the storage tank 14.

Additionally, water heater 10 includes a control assembly 38 for controlling the supply of gas to burner assembly 18 in response to the sensed temperature of the water within storage tank 14. A drain spigot and valve assembly 40 is also provided for enabling the user of the water heater 10 to periodically flush debris from the bottom of tank 14 as well as to drain the tank 14 in the event of any necessary maintenance. To actually heat water in the storage tank 14, the burner assembly 18 is utilized in conjunction with control assembly 38.

The burner assembly 18 heats the water in the storage tank 14 by utilizing a pilot light 42, which produces a flame 44, an igniter 46, which is used to light the pilot light 42, a gas line 48 that directs the flow of gas to the burner assembly 18, and a flame sensor 50. The flame sensor 50 is normally a device that sends a signal to the control assembly 38 upon sensing the presence of a flame 44. The control assembly 38 is used by a user to govern the temperature of the water within the storage tank 14 and thus the amount and duration of natural gas supplied to the burner assembly 18. Upon utilization of the burner assembly and the subsequent heating of water within water area 20 of the storage tank 14, combustion gases from the flame 44 pass upward through the flue pipe 24 to the upper end 26 of the water heater 10.

Figure 2:
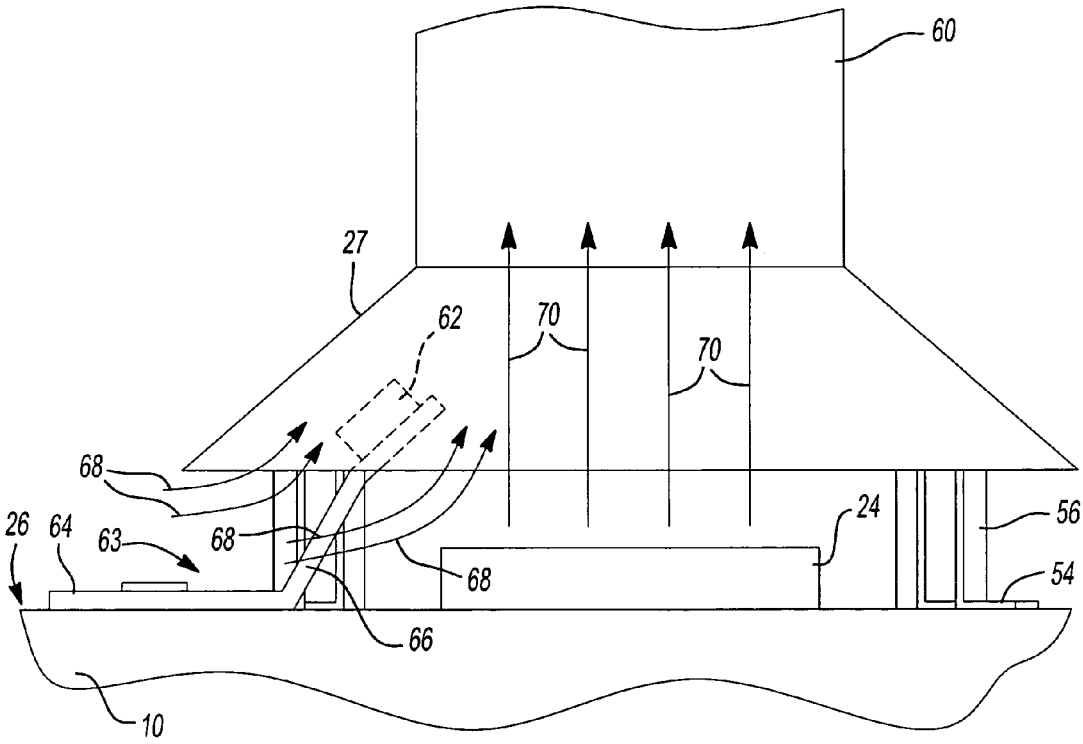
FIG. 2 is a side view of a water heater depicting a draft hood and example position of a combustion gas parameter sensor.
Figure 3:
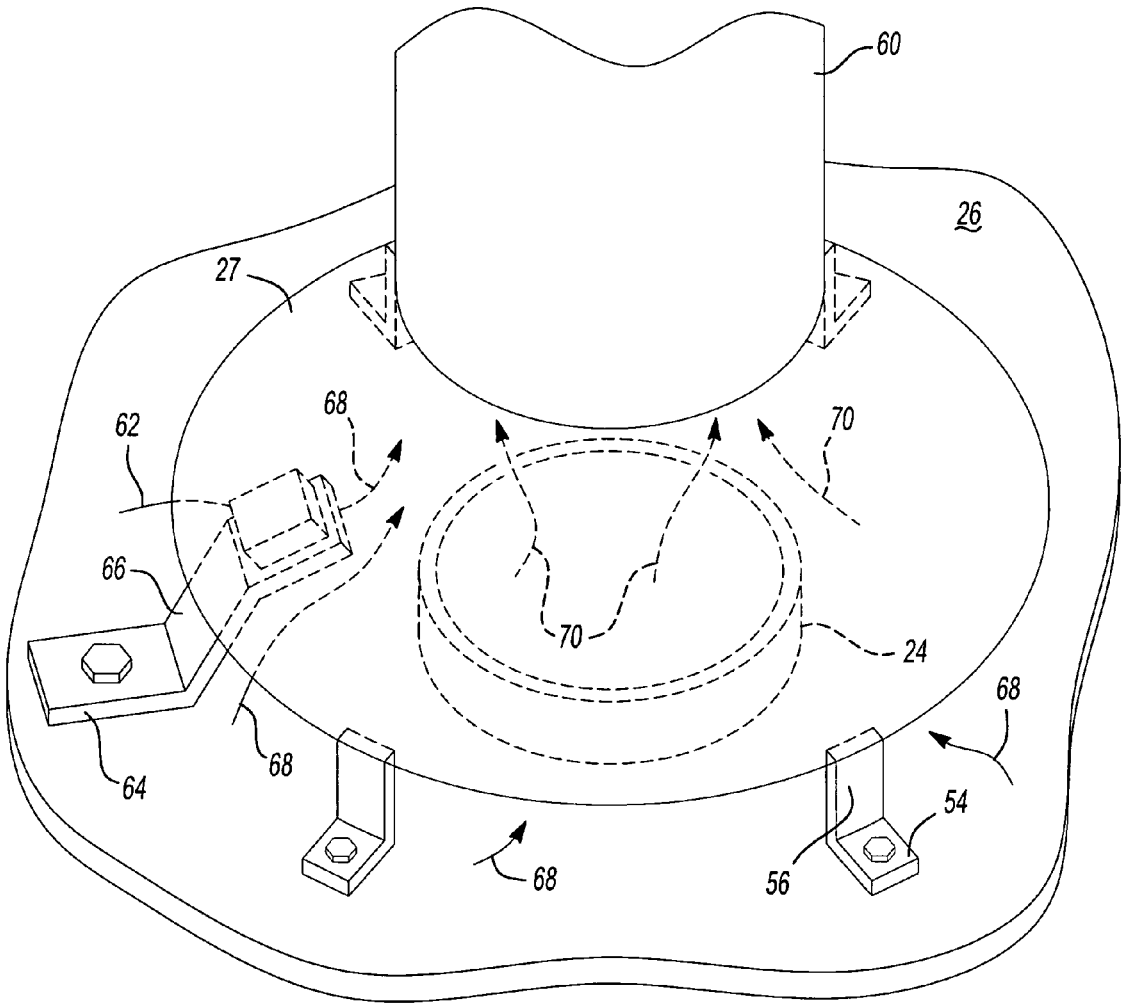
FIG. 3 is a perspective view of a water heater depicting a draft hood, flue pipe, exhaust chimney, and example location of a combustion gas parameter sensor.
Figure 4:
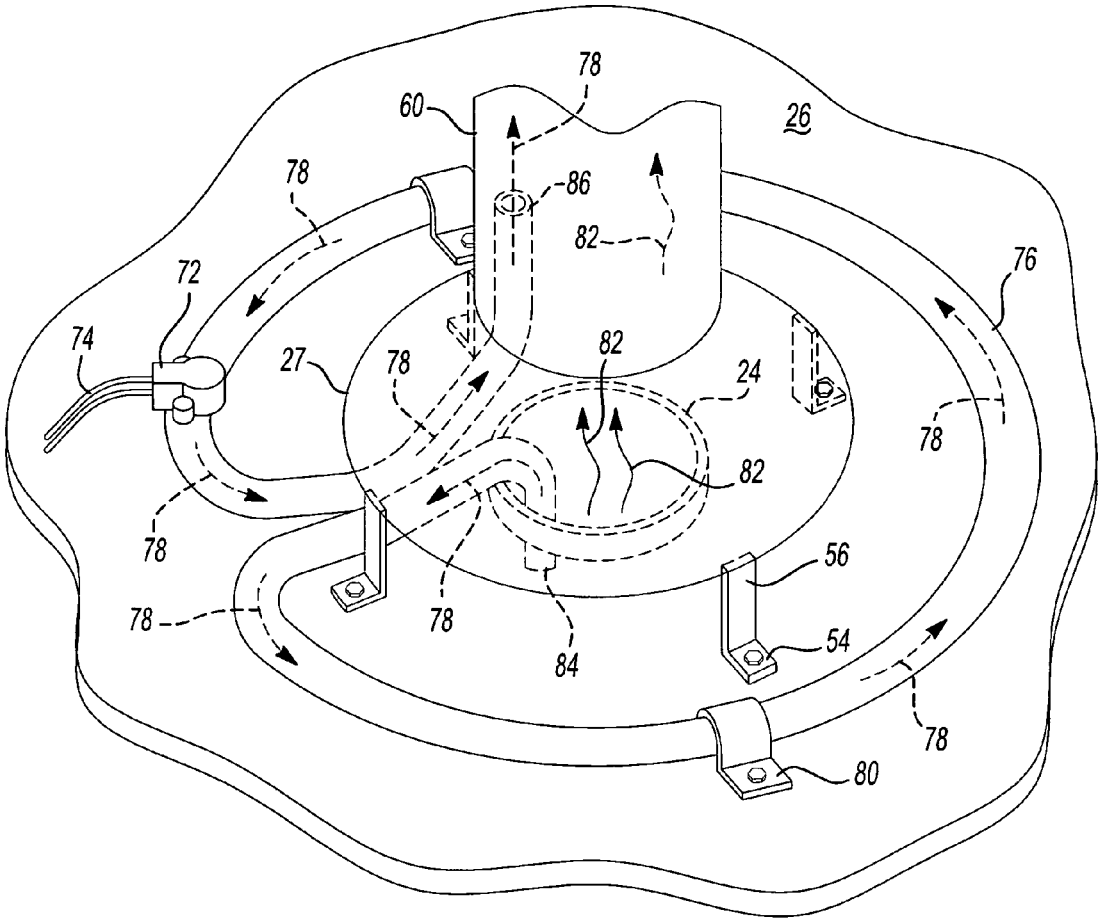
FIG. 4 is a perspective view of another embodiment depicting placement of a draft hood, exhaust flue, chimney and example placement of a combustion gas parameter sensor.

Once at the upper end 26 of the water heater 10, the combustion gases exit the upper end 26 via the exhaust outlet 24 and pass into and through the draft hood 27. The draft hood 27 is secured in place by a number of hood legs 52. Each hood leg 52 has a hood foot 54 and a hood riser 56 that together serve to create an air gap 58. The air gap 58 permits air to pass into the draft hood 27 to facilitate and hasten the passage of combustion gases into the chimney 60. The warmed combustion gases exiting through the chimney 60 facilitate the drawing of air through the air gap 58 due to convection currents caused by the phenomenon of heat rising. As thus far described, water heater 10 is of a construction typical for gas water heaters currently in use. FIGS. 2-4 will now be more specifically referred to, in conjunction with FIG. 1, to better depict the operative workings of the present invention.

FIGS. 2 and 3 depict an upper end 26 of a water heater 10 depicting a location of a combustion gas sensor 62. As depicted, the combustion gas sensor 62 is located under the draft hood 27, and more specifically, in FIG. 2, the combustion gas sensor 62 is located under the slanted or angular portion of the draft hood 27, relative to the upper end 26, which is horizontal, of the water heater 10. The combustion gas sensor 62 is positioned under the draft hood 27 by using a sensor bracket 63. The sensor bracket 63 has a sensor bracket foot 64 and a sensor bracket riser 66. The sensor bracket foot 64 is secured to the upper end 26 by using a suitable fastener, such as a screw, rivet or bolt. By utilizing a sensor bracket 63, the combustion gas sensor 62 can be manipulated under the draft hood 27 for easy installation. Additionally, by making the combustion gas sensor 62 a separately positioned piece, advantages of the sensor 62 relative to the combustion gases are realized.

An advantage of the combustion gas sensor 62 and the sensor bracket 63 is that it can be added to any existing gas fired appliance where monitoring of specific gas parameters such as, but not limited to, CO, NOx and $O_2$ are desired to be monitored. Another advantage of the combustion gas sensor 62 is that its placement permits ambient air to be drawn over its entire surface to cool the sensor 62, due to its placement in a position of elevated temperatures. More specifically, generally horizontal currents 68 are drawn around the combustion gas sensor 62 when the gas fired burner assembly 18 is fired and supplying heat to the water in the storage tank 14. The generally horizontal air currents 68 are generated by the combustion gas vertical currents 70, which result from the general burning of gas by the gas fired burner assembly 18. When the heated combustion gasses rise through the flue pipe 24 and exit the flue pipe 24, the gases continue upward, past the upper end 26, into the draft hood 27, and into the chimney 60. The heated combustion gases are represented by the vertical currents 70. The heat of the vertical currents causes generation of convection currents which results in the horizontal currents 68 being drawn from outside the draft hood 27, into the draft hood 27 and subsequently up the chimney 60 to join and mix with the vertical currents 70.

Because gas fired appliance combustion gases typically can reach 300 degrees C., placement of a combustion gas sensor near the combustion gases, or directly in the flow of the combustion gases, may result in malfunctioning of a combustion gas sensor or a shortened life span of such a sensor. However, with the arrangement depicted in FIGS. 2 and 3, because the combustion gas sensor 62 is located away from the vertical currents 70 of the combustion gases but in the flow of horizontal currents 68, the sensor 62 does not suffer from the disadvantages of being proximate to, or in, 300 degree C. combustion gases. By placing the combustion gas sensor 62 under the draft hood 27 as depicted in FIGS. 2 and 3, horizontal currents are permitted to flow around all sides of the combustion gas sensor 62. The currents can flow between the wall of the draft hood 27 and the sensor 62, and between the sensor 62 and the upper end 26. In this fashion, the life of the combustion gas sensor 62 can be prolonged, and combustion gases can be detected long before such gas might "back up" and spill out of the draft hood 27.

Another advantage of the placement of the combustion gas sensor 62 as depicted in FIGS. 2 and 3 is that it can detect combustion gases at all times, that is, continually. More specifically, combustion gases are detectible when the gas fired appliance is normally operating or combusting, when the flue pipe is blocked downstream of the sensor 62, and when there is blockage upstream of the sensor 62.

Contrary to that depicted in FIGS. 1-4, if a gas sensor, such as a CO detector, is located away from the draft hood, then CO is typically not detected until such CO gases "back up" and spill outside of the draft hood and reach a remote CO detector. This scenario normally would occur when, for instance, the appliance chimney is blocked. In another scenario, when there is blockage of the intake air around the burner assembly at the bottom of a water heater, then CO may not be detected at all since there is simply a blockage of air intake, even though combustion is not proper, which may result in combustion gas imbalances. In such a scenario, the combusted gases would pass through the appliance undetected, or back up at the bottom of the appliance, causing a delayed detection of elevated CO in the exiting combustion gases.

By placing the combustion gas sensor 62 as depicted in FIGS. 2 and 3 the forgoing scenarios are avoided, and flue gases can be detected before they spill out of the draft hood 27 or other possible appliance outlet. Although not shown, a wire or control cord connects the combustion gas sensor 62 to the control assembly 38. In the event of unfavorable combustion flue gas detection, the combustion gas sensor 62 causes the control assembly 38 to shut off the gas fired appliance so that combustion is halted. FIG. 4 is another arrangement of a flue gas sensor that also permits flue gas detection, and will now be explained.

FIG. 4 depicts another arrangement of a flue gas sensor 72. In such an arrangement, the flue gas sensor 72 fluidly communicates through a wall of a flue gas sampling tube 76 that is secured to the upper end 26 by a bracket 80. A communication wire 74 effectively communicates the gas sampling findings to the control assembly 38. In the event the gas sampling findings warrant shutting off of the appliance 10, such as in the detection of an unsafe level of CO, the control assembly 38 will communicate with the burner assembly 18 to do such. The sensor 72 is located on the sampling tube 76 to permit the sensor 72 to be located away from the elevated temperatures of combusted flue gas, which may contribute to a shortened sensor life. A shortened sensor life is avoided, and in fact, sensor life is optimized by locating the sensor 72 on the gas sampling tube 76. Not only is the sensor 72 located away from the heated combustion gas flow 82 of the combustion gases 82 exiting from the flue pipe 24, but the sample gas 78, or gas within the sampling tube 76, is permitted to cool as the gas progresses through the sampling tube 76. Heat is transferred from the sample gas 78 to the tube 76 and then into the air surrounding the tube 76. To facilitate heat transfer, a material such as copper or aluminum may be used for the tube 76, although other materials may be used. Furthermore, longer tube 76 lengths can be used when increased heat transfer is desired.

An advantage of the sampling tube 76 is that as the gas is permitted to pass through the sampling tube 76, which coils around the upper end 26 of the heater 10, the gas cools, which prolongs sensor 72 life. In the event of the necessity of a sampling tube 76 longer than that depicted in FIG. 4, the sampling tube 76 may be coiled around the flue pipe 24, outside the perimeter of the draft hood 27, in multiple coils. By causing the sample gas 78 to travel farther through the sampling tube 76, the heat transfer out of the sample gas 78 will continue before the gas reaches the sensor 72.

In order for the combustion gas sensor 72 to be supplied with a steady flow of combustion gas, a first sample tube end 84 is inserted down into the flue pipe 24 while a second sample tube end 86 is inserted up into the chimney 60. By arranging the tube in such a manner, the heated combustion gas 82 rising into the chimney 60, draws sampling gas 78 through the sampling tube 76, that is, in the first end 84 and out the second end 86. The sampling gas 78 is forced into the sampling tube by the heated, rising gas 82 and further fostered by the drawing action at the second end 86, which is caused by convection currents of the heated gas passing the second end 86.

Another advantage of using the sampling tube 76 is that the combustion gas sensor 72 and sampling tube 76 may be installed as an add-on option to existing water heaters or other gas fired appliances not so equipped. The flue gas sensor depicted in the figures and described above may be any kind of combustion gas sensor. For instance, the sensors may sense CO, NOx, or $O_2$ parameters; however, other gas components may be sensed as such need becomes evident.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for detecting combustion gas emissions from an appliance, the apparatus comprising:

an exhaust outlet proximate a top surface of the appliance through which combustion gases exit the appliance in generally vertical currents;

a draft hood located proximate said exhaust outlet and defining an interior volume;

a combustion gas sensor located within said interior volume of said draft hood and away from the generally vertical currents of combustion gases; and a sensor bracket having a first end and a second end, said combustion gas sensor attached to said first end and extending under said draft hood, said second end attached to the appliance.

2. The apparatus of claim 1, wherein the combustion gas sensor is disposed above a lower edge of the draft hood.

3. The apparatus of claim 1, wherein said combustion gas sensor is located above said top surface of the appliance.

4. An exhaust gas parameter detection apparatus for a gas fired appliance, the apparatus comprising:

an exhaust gas outlet;

an exhaust gas chimney for receiving exhaust discharged from said exhaust gas outlet;

a draft hood located between the exhaust gas outlet and the exhaust gas chimney, the draft hood including an inclined surface and defining an interior volume;

a sensor disposed within said interior volume of said draft hood and between said exhaust gas outlet and said exhaust gas chimney for sensing gas parameters in the exhaust, the sensor being located outside of the flow of exhaust gas exiting from the exhaust gas outlet; and a sensor bracket, wherein said sensor bracket elevates said sensor above said appliance and adjacent to the inclined surface of said draft hood.

5. The apparatus of claim 4, wherein said sensor is positioned such that air gaps are defined between said draft hood and said sensor and between said appliance and said sensor.

6. The apparatus of claim 4, wherein said sensor is located in a draft flow of air entering from outside of the draft hood, said draft flow of air created by the exhaust flow into said chimney, and said sensor is located proximate said exhaust flow to sample gas parameters in the exhaust.

7. An exhaust gas parameter detection apparatus comprising:

an exhaust outlet;

an exhaust chimney for receiving exhaust gas from said exhaust outlet;

an exhaust gas tube having a first end and a second end, wherein said first end of said exhaust gas tube resides within said exhaust outlet and said second end of said exhaust gas tube resides within said exhaust chimney; and a sensor located on said exhaust gas tube for sensing gas parameters within said exhaust gas tube.

8. The apparatus of claim 7, wherein said exhaust gas tube encircles said exhaust outlet.

9. The apparatus of claim 7, wherein said exhaust gas tube encircles said exhaust outlet in multiple coils.

10. The apparatus of claim 7, wherein said sensor is located outside a perimeter of the exhaust gas draft hood.

11. The apparatus of claim 7 wherein the first end and the second end of the exhaust gas tube are oriented parallel to a flowing path of exhaust gas.

12. The apparatus of claim 7 wherein the exhaust gas tube is provided between the exhaust chimney and the exhaust outlet.

* * * * *